US006189468B1

(12) United States Patent
French

(10) Patent No.: US 6,189,468 B1
(45) Date of Patent: Feb. 20, 2001

(54) SUPPORT FOR CAP EMBROIDERY FRAMES WITH TENSION MEMBER

(76) Inventor: Nick L. French, 571 Watson Rd., Erlanger, KY (US) 41018

( * ) Notice: Under 35 U.S.C. 154(b), the term of this patent shall be extended for 0 days.

(21) Appl. No.: 09/531,374

(22) Filed: Mar. 21, 2000

(51) Int. Cl.[7] ..... D05C 9/04
(52) U.S. Cl. ..... 112/103
(58) Field of Search ..... 112/103, 309, 112/475.11, 470.18; 38/102, 102.91

(56) References Cited

U.S. PATENT DOCUMENTS

| | | | |
|---|---|---|---|
| 508,315 | 11/1893 | Howell . | |
| 3,421,355 | 1/1969 | Kramer . | |
| 4,598,488 | 7/1986 | Inteso . | |
| 4,617,818 | 10/1986 | Fukuyori . | |
| 4,628,843 | 12/1986 | Tajima . | |
| 4,665,844 | 5/1987 | Shibata . | |
| 4,831,753 | 5/1989 | Inteso . | |
| 4,998,964 | 3/1991 | Golia . | |
| 5,237,941 | 8/1993 | Kraft et al. . | |
| 5,261,338 | 11/1993 | Tajima et al. . | |
| 5,507,241 | 4/1996 | Evans . | |
| 5,553,560 * | 9/1996 | Tajima et al. | 112/103 |
| 5,598,797 | 2/1997 | Patterson . | |
| 5,649,496 * | 7/1997 | Morita et al. | 112/103 |
| 5,701,831 | 12/1997 | Morita . | |
| 5,819,675 | 10/1998 | French et al. . | |
| 5,832,853 | 11/1998 | Pokrishevsky et al. . | |
| 5,887,534 | 3/1999 | French et al. . | |
| 5,915,314 * | 6/1999 | Moore, III | 112/470.18 X |

* cited by examiner

*Primary Examiner*—Ismael Izaguirre
(74) *Attorney, Agent, or Firm*—Rhodes & Mason P.L.L.C.

(57) ABSTRACT

A cap framing gauge for supporting a cap as the cap is mounted on an embroidering cap frame wherein the frame is subsequently mounted on automated embroidery equipment. The cap framing gauge includes a cap tensioning member pivotally attached to the cap framing gauge. The member is biased rearwardly in a direction away from the embroidered portion of the cap held on the frame so as to engage and hold the cap in a taut position.

9 Claims, 4 Drawing Sheets

SUPPORT FOR CAP EMBROIDERY FRAMES WITH TENSION MEMBER

FIELD OF THE INVENTION

The present invention relates to the field of automated embroidery processes, and, more particularly to fixtures for properly positioning caps on an embroidery frame in preparation for the embroidery operation.

BACKGROUND OF THE INVENTION

In the conventional manufacture of caps (e.g., baseball caps) bearing embroidered logos on the front of the cap crown, each finished cap is mounted on a frame and the frame is mounted on or in an embroidery machine. The frame is intended to hold the front crown in place with minimal movement, stretch, or distortion during the embroidery operation.

Known cap frames include the Tajima/Melco available from Tajima of Japan. Mounting a cap on this frame can be time consuming for embroidery machine operators because the frames are awkward to handle. It has been observed that some of the efficiencies provided by large scale automated embroidery equipment are lost because an excessive amount of time is tied up mounting caps on the cap frames. Essentially, the embroidery machines can sometimes complete their work faster than workers can mount caps properly on the frames. The resulting lost time can lead to a significant cost disadvantage for the preparation of a large order of embroidered caps.

The industry has responded to these problems with a device called a cap "framing gauge" which is designed to provide a temporary mount for a cap embroidery frame so that both hands of a worker are available to properly position a cap on the frame. The framing gauge, as used herein and as known in the art, is a support device that simulates the mounting apparatus of an embroidery machine and thus simplifies mounting a cap on a cap frame. The framing gauge will include frame mounting elements similar to those on the actual automated embroidery equipment. Experience has shown that while the framing gauges do address the problem described above, it can still be difficult to properly position a cap on a cap frame that is mounted on a framing gauge. This is because it is difficult to stretch and maintain the front of the cap in a taut condition as it is mounted on the frame. While both the worker's hands are engaged in mounting the cap and manipulating the frame, the remaining portion of the cap is relaxed. This condition can lead to the cap being improperly positioned on the cap frame.

There exists a need for an improved cap framing device that addresses the above-mentioned problems. These and other needs are addressed by the present invention.

SUMMARY OF THE INVENTION

The present invention makes embroidery cap frames easier to use by providing the framing gauge with a means to tension the cap as it is mounted on the cap frame. The invention permits an automated embroidery equipment operator to use both his/her hands to insure that a cap to be embroidered is mounted on the frame properly while at the same time maintaining a certain amount of tension on the cap. The cap is held in a taut position as it is mounted. The cap is thus more likely to be positioned corrected on the cap frame, increasing the chances that the cap will be embroidered properly.

The present invention overcomes the problems in the prior art by providing a tensioning member on the framing gauge for holding cap embroidery frames while caps are properly positioned and tensioned on the frames in preparation for a subsequent embroidery operation. The gauge includes one or more bases, each with a cap frame mounting fixture at one end and a cap tensioning member pivotally attached to the opposite end. The tensioning member is biased in a direction away from the embroidered portion of the cap being held on the frame so as to engage the rear portion of the cap and hold the cap front in a taut position until the frame is closed.

In a preferred embodiment, the base includes an arcuate front portion. A plurality of cap frame engagement members are secured to the base adjacent the arcuate portion. The cap frame engagement members are sized and shaped to engage at least some of the cap frame mounting apertures. A cap tensioning member is pivotally attached at or adjacent the other end of said base, and is biased in a direction away from the one end.

The support may further include a curved support surface secured to the one end of the base. The support surface has a radius of curvature less than that of said base arcuate top portion. This embodiment may also include a plurality of cap frame stops secured to the base, the cap frame stops including a leg extending across said curved support surface in parallel spaced apart relationship thereto and a substantially resilient protuberance attached to the second side of the base. The protuberance is positioned so as to engage a cap frame circular support member.

The present invention further relates to a method of holding a cap securely as it is mounted on an embroidering cap frame held in place by a cap framing gauge. The method includes the steps of engaging the rear portion of the cap with a cap tensioning member pivotally attached to the cap framing gauge. The tensioning member is biased rearwardly in a direction away from the embroidered portion of the cap so as to engage and hold the cap in a taut position when released.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE PREFERRED EMBODIMENT

Figure 1:
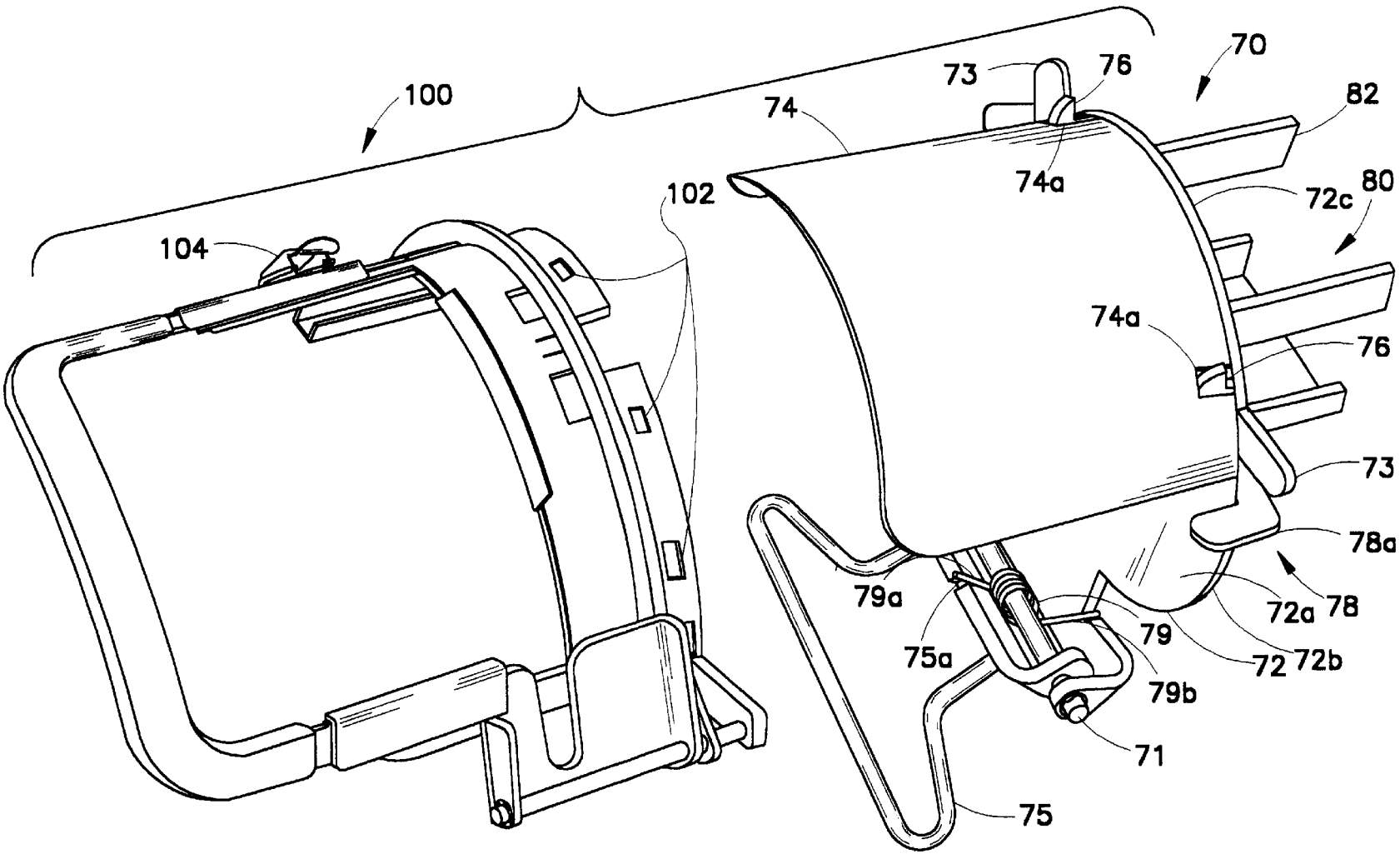
FIG. 1 is an exploded perspective view illustrating a cap frame adjacent the cap framing gauge or support of the present invention prior to the installation of the cap frame thereon.
Figure 2:
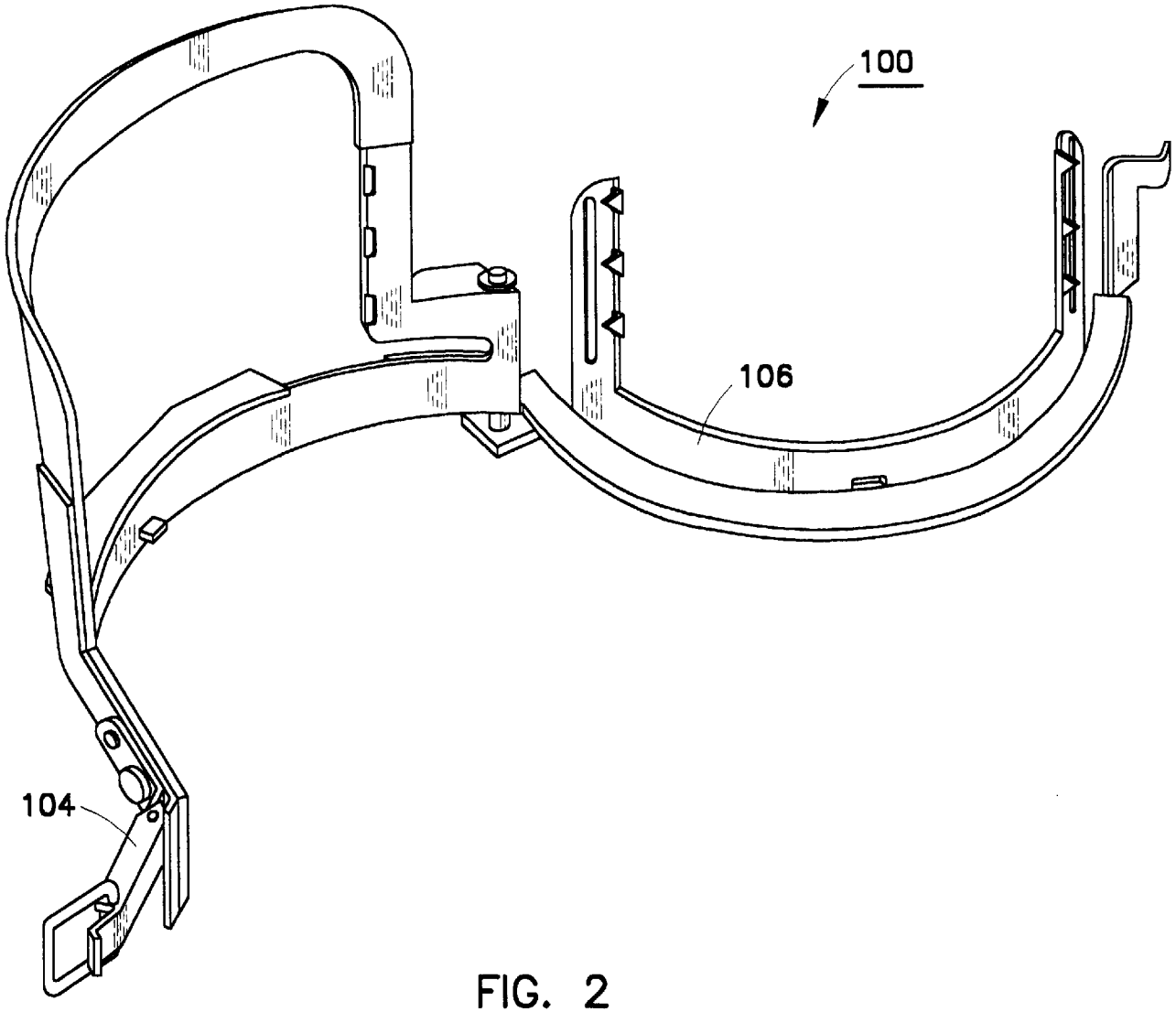
FIG. 2 is a perspective view of a cap frame in an open position ready to receive a cap therein.
Figure 3:
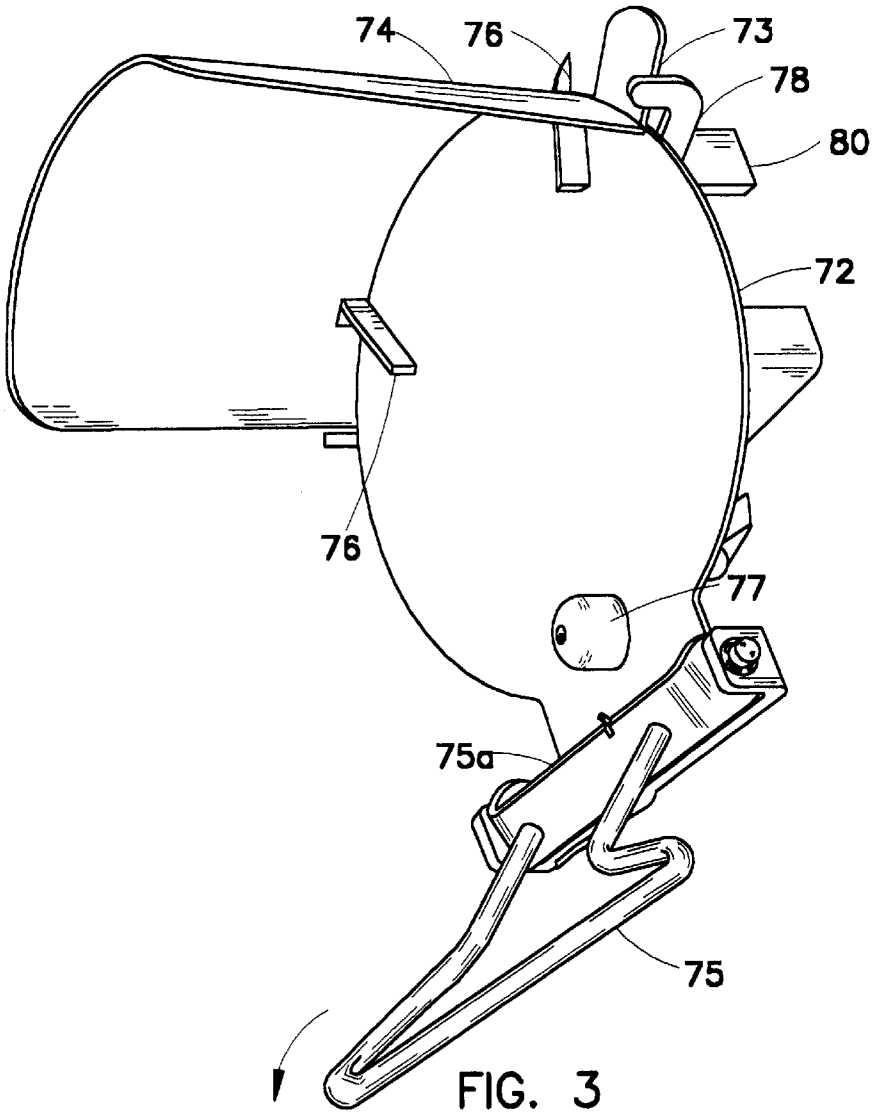
FIG. 3 is a perspective view of the cap framing gauge of the present invention.

Referring to FIGS. 1–4 there is illustrated a portion of a a cap frame gauge which includes a base 72 having an upper surface 72*a* and a lower surface 72*b*. The fall gauge (not shown) may include one or more base members 72 for mounting multiple caps or, as illustrated in FIG. 1, there may be only ne base 72. The base 72 has an arcuate front portion 72*c* to which is secured a curved support surface 74. In a preferred embodiment, the curved support surface 74 has a radius of curvature slightly less than that of the base arcuate top portion. Thus, the edge of the curved support surface 74 lies inside the edge of the edge of the base 72. A plurality of frame engagement members 76 are secured to the first side 72*a* of the base 72 adjacent the arcuate top portion 73*c*. The engagement members 76 extend upwardly above the base 72 and the curved support surface 74 through corresponding openings 74*a* in the curved support surface 74. Desirably, at least two of the projecting support members 76 are provided. The preferred embodiment depicted in the figures includes two stops 78 positioned at approximately a "10 o'clock" and a "2 o'clock" position on the arcuate portion of the base 72. As best seen in FIGS. 1 and 3 each of the stops 78 includes an extending leg portion 78*a* that is parallel to and spaced laterally apart from the curved support surface 74. The present invention further includes positioning tabs 73 that are formed integrally with the base 72. The tabs extend outwardly from the arcuate base edge and assist the user in the handling of the cap framing gauge during its use.

A mounting knob 77 is secured to the first side of the base 72 using fastener 77*a*. The knob preferably is comprised of a thermoplastic material, including, but not limited to polyethylene. In a preferred embodiment, the mounting knob 77 has a rounded dome-like shape. The knob provides additional holding support for those cap frames that have circular mounting structures known in the art as barudan frames. Thus, the knob 77 should be positioned at a point below the curved surface so as to engage the circular mounting ring. Although the thermoplastic material making up the knob is essentially rigid, the material does have a smooth surface and a slight amount of compressibility that permits the circular portion of the cap frame to be slipped over the knob.

A tensioning member 75 is pivotally attached to the base 72 via pin 71 at a point below the curved support surface 74. Desirably, the tensioning member 75 is biased in a direction rearwardly away from the curved support surface 74 and thus from the portion of the cap that is being embroidered. The term "rearwardly" as used herein refers to any direction that is opposite of and away from the cap portion of be embroidered when the cap is mounted in the cap frame. Although typically the crown of a cap is embroidered, the side or rear portions of a cap might also be embroidered. This direction may vary depending on the particular orientation of the framing gauge during use. In this preferred embodiment, a means for biasing the tensioning member 75 in the form of a spring 79 is provided. The spring 79 is mounted on the pin 71 and includes a first leg 79*a* that mates with a slot 75*a*. A second leg 79*b* engages a recess in the base 72. It will be readily appreciated that pulling the tensioning member 75 upwardly compresses the spring 79. In the preferred embodiment depicted in FIG. 1, tensioning member 75 is generally T-shaped so as to maximize its tensioning effect on the cap being embroidered. The tensioning member may have a width between about 3 and about 5 inches depending on the size and type of cap to be used with the frame. Other shapes for the tensioning member that may be used include, but are not limited to, circular or rectangular. Although a coil spring is illustrated in the Figures, some other type of spring or means for biasing the tensioning member 75 may be provided. For example, a flat leaf spring may be used or a spring-like structure may be constructed integrally with the tensioning member 75.

A mounting bracket assembly 80 is secured to the second side of base 72. The assembly 80 includes a U-shaped member which cradles a support surface 90 in the recess of the member 82. Thumb screw 84 extends upwardly through the lower surface of the U-shaped member 82 to secure the bracket assembly 80 and thus the entire cap framing gauge 70 to the support surface 90. The dimensions of the U-shaped member may be varied as needed to adapt to a variety of support surfaces 90. It will be readily appreciated the construction of the bracket assembly 80 may be varied greatly depending on the shape and orientation of the available support surface.

Figure 4:
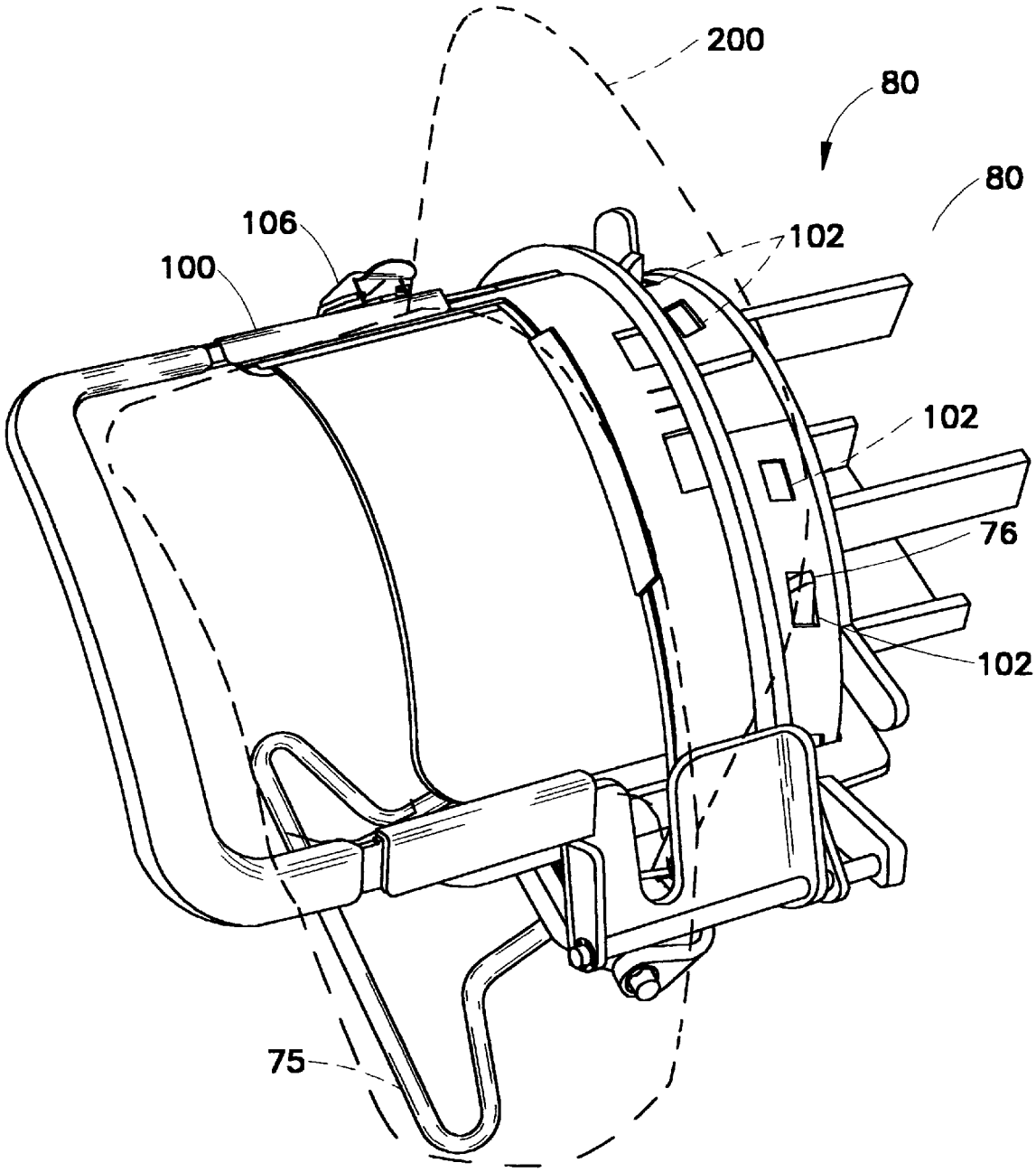
FIG. 4 is a perspective view of a cap frame installed on the cap framing gauge of the present invention with a cap installed in the cap frame and shown in phantom.

The operation of the tensioning member 75 is illustrated in FIGS. 1, 2, and 4. A cap frame 100 in FIG. 1 is of a known type which is of a known type which includes a plurality of mounting apertures 102 that are sized and spaced to engage corresponding mounting members in a particular type of automated cap embroidery machine. These machines are well known in the art and are supplied by companies to include Toyota and Tajima. The cap frame 100 is shown in a closed position but without a cap installed thereon for the purposes of clarity and to better illustrate the fit between the cap frame 100 and the cap frame gauge 70. The cap frame 100 may be any suitable model used in the field of automated cap embroidery. By way of non-limiting example, the cap frame disclosed in U.S. Pat. No. 5,819,675 may be used. The content of that patent is incorporated herein in its entirety. As shown in FIG. 1, the cap frame 100 is aligned with the cap framing gauge 70 so that certain of the mounting apertures 102 are lined with the engagement members 76. The cap frame 100 may have more apertures 102 then the cap frame gauge 70 will have engagement members 76. The cap frame 100 is mounted on cap frame and gauge 70 by aligning the apertures 102 with the engagement member 76 and fitting the cap frame 100 into place.

After mounting on the cap framing gauge 70, the cap frame 100 is opened by releasing clasp 106 so that the arcuate member 104 may be swung to the open position for installation of a cap. FIG. 2 is an illustration of the cap frame of the '675 patent in an open position. The rear of the cap sweat band is placed over the tensioning member 75 so that the tensioning member 75 engages the interior rear surface of the cap. As the front of the cap is pulled over the curved support surface 74 into place on the inner arcuate portion 106 of the cap frame, the tensioning member 75 holds the cap in a taut, stretched position. Tensioning member 75 frees both the operator's hands to mount the cap on the frame. The force exerted against the cap stabilizes the cap as it is mounted. The cap is thus less likely to slip out of position and more likely to be positioned correctly in a minimum amount of time.

As illustrated in FIG. 4, the outer arcuate member 104 is then closed over the cap 200 (shown in phantom) so as to hold the cap in place securely. The tensioning member 75 holds the cap in a taut position on the cap frame 100 during the installation of the cap on the frame and then as the cap frame is installed on the automated embroidery machine.

As seen in FIG. 4, the cap frame 100 is held in place by cap frame engagement members 76 which extend upwardly through cap frame apertures 102. In this preferred embodiment, two such members 76 have been provided although it will be possible to use a different number without departing from the scope of the invention. A cap frame 100 is also supported by the small portion of the base 72 that is exposed by the difference in radius between the curved support surface 74 and the arcuate top portion of the base 72. The cap frame stops 78 assist in guiding the cap frame 100 into proper position against the base 72. The cap frame 100 may come into contact with the cap frame stops 78 as the cap frame 100 is being installed on the framing gauge 70. However, once installed, the cap frame 100 will not necessarily contact the extending leg portion 78 of each cap frame stop.

As seen in FIG. 4, the curved support surface 74 extends under the open embroidery area of the cap frame 100. The curved support surface 74 insures that the cap embroidery area, primarily crown portion of the cap, is stretched across a curved, firm surface to prepare the cap for embroidery in the automated equipment.

Although the present invention has been described with preferred embodiments, it is to be understood that modifications and variations may be utilized without departing from the spirit and scope of this invention, as those skilled in the art will readily understand. For example, the tensioning member could be made a part of the cap frame, if the ap frame provided some place to support the tensioning member. Such modifications and variations are considered to be within the purview and scope of the appended claims and their equivalents.

What we claim is:

1. A support for holding cap embroidery frames while caps are properly positioned and tensioned on said frames in preparation for a subsequent embroidery operation, said support comprising:

a. a base with a cap frame mounting fixture at one end;

b. a cap tensioning member pivotally attached to an opposing end of said base;

c. wherein said tensioning member is biased in a direction away from the embroidered portion of the cap being held on the frame so as to engage and hold the cap front in a taut position until the frame is closed.

2. An apparatus according to claim 1 wherein said cap tensioning member is T-shaped.

3. A support for holding an embroidering cap frame as a cap is mounted on the frame in preparation for a subsequent embroidery operation, the cap frame including a plurality of mounting apertures for engagement with the automated embroidery equipment, the support comprising:

a. a base having an arcuate top portion and first and second sides;

b. a plurality of cap frame engagement members secured to the first side of said base and sized and shaped to engage the cap frame mounting apertures; and c. a cap tensioning member pivotally attached to the second side of said base wherein said member is biased in a direction away from said plurality of cap frame engagement members.

4. An apparatus according to claim 3 further comprising a curved support surface secured to the first side of said base wherein said support surface has a radius of curvature less than that of said base arcuate top portion.

5. An apparatus according to claim 4 further comprising a plurality of cap frame stops secured to said base, said cap frame stops including a leg extending across said curved support surface in parallel, spaced apart relationship thereto.

6. An apparatus according to claim 3 further comprising a substantially resilient protuberance attached to the second side of said base, said protuberance positioned so as to engage a cap frame circular support member.

7. An apparatus according to claim 3 further comprising a plurality of handling tabs integral with and extending from the curved top portion of the base.

8. A method of holding a cap securely as it is mounted on an embroidering cap frame held in place by a cap framing gauge, the method comprising the steps of:

a. engaging the rear portion of the cap with a cap tensioning member pivotally attached to the cap framing gauge; and b. releasing said tensioning member to be biased in a direction away from the embroidered portion of the cap so as to engage and hold the cap in a taut position.

9. The method of claim 8 wherein said cap tensioning member is T-shaped.

* * * * *